United States Patent [19]

Honda et al.

[11] 4,305,015

[45] Dec. 8, 1981

[54] SEALED BEAM LAMP INCLUDING HALOGEN BULB WITH LIGHT SHIELDING LAYER

[75] Inventors: Kiyokazu Honda, Zushi; Yasuhiro Nieda, Yokosuka, both of Japan

[73] Assignee: Tokyo Shibaura Denki Kabushiki Kaisha, Kawasaki, Japan

[21] Appl. No.: 100,880

[22] Filed: Dec. 6, 1979

[30] Foreign Application Priority Data

Dec. 8, 1978 [JP] Japan ..... 53-151063

[51] Int. Cl.[3] ..... H01K 1/32

[52] U.S. Cl. ..... 313/113; 313/117; 313/222

[58] Field of Search ..... 313/117, 221, 113, 222; 427/106; 106/48, 312

[56] References Cited

U.S. PATENT DOCUMENTS 1,691,832 11/1928 Sweet ..... 313/117

3,784,861 1/1974 Notelteirs et al. ..... 313/117

FOREIGN PATENT DOCUMENTS 933577 9/1973 Canada ..... 313/222

952939 3/1964 United Kingdom ..... 313/222

OTHER PUBLICATIONS

"Modern Tungsten Halogen Lamp Technology", by J. R. Coaton, *Proc. IEE*, vol. 117, No. 10, Oct. 1970, pp. 1953–1959, p. 1957 and FIG. 8.

*Primary Examiner*—Palmer C. Demeo

*Attorney, Agent, or Firm*—Cushman, Darby & Cushman

[57] ABSTRACT

A sealed beam lamp is provided, comprising a lamp envelope comprised of a reflector having an open front and a lens attached to the edge of the reflector, and a halogen bulb attached to the lamp envelope so as to face the lens and having a straight filament arranged along a direction of the diameter thereof and substantially parallel with the lens and a bulb envelope whose upper end surface portion is covered with a light-shielding layer except for those side wall portions of the bulb envelope facing the ends of the straight filaments.

7 Claims, 7 Drawing Figures

SEALED BEAM LAMP INCLUDING HALOGEN BULB WITH LIGHT SHIELDING LAYER

BACKGROUND OF THE INVENTION

This invention relates to an improved sealed beam lamp.

A sealed beam lamp having a small-sized halogen bulb in a reflector equipped at its open front side with a lens has recently been developed as a lamp suitable, for example, for a headlight of an automobile. Such sealed beam lamp has the advantage of, for example being higher in light emission efficiency and longer in service life and providing a high output feature.

FIG. 1 is a cross-sectional view showing one form of a sealed beam lamp having a halogen bulb.

A reflector 12 is equipped at its open front side with a lens 14. A halogen bulb 16 has its filament lead lines 18, 20 fixed by ferrules 22, 24 to the reflector 12. A reflective layer 28 such as an aluminum layer is formed on the inner surface of the reflector 12 to reflect a beam of light from the halogen bulb 16. It is required that a beam of light emitted from the sealed beam lamp be focussed onto a predetermined distant spot, that is to say, a beam of light emitted from the filaments of the halogen bulb 16 be externally emitted through the lens 14 after it is once reflected on the reflective layer and converted to a parallel beam of light. Since a scattering light directly externally emitted from the halogen bulb gives a dazzling effect to a driver on the oncoming vehicle it has to be shielded. In general, the filaments of such halogen bulb are arranged axially of the bulb (as often encountered in the European countries) or along a direction of the diameter of the bulb (as often encountered in the U.S.A. and Japan). FIG. 2 is a diagrammatic view showing a conventional halogen bulb structure having filaments along a direction of the diameter of the bulb. In this type of bulb, a heat-resistant light-shielding layer 42 made of, for example, graphite is formed on the upper end surface portion of the bulb to shield a direct external emission of the scattering light. In this arrangement, a beam of light which strikes the inner surface of the upper end portion of the bulb is directed toward, and reflected on, the reflective layer where it is converted into a parallel beam of light so that it can be externally focussed through the lens 14 onto a predetermined distant spot. It is therefore possible to prevent a direct external emission of a scattering light through the lens 14. Since, generally, the ends of the straight filaments 36, 38 of the halogen bulb are located in close proximity to the side wall of the bulb envelope, those side wall portions 44, 46 of the bulb envelope facing the ends of the filaments suffer a greater amount of heat and are heated to a high temperature. For this reason, a harmful gas is produced from the bulb envelope portions 44, 46. Due to the presence of the gas, a halogen cycle becomes somewhat inactivated, leading to an earlier local blackening of the bulb and the attendant reduction of the service life of the halogen bulb.

SUMMARY OF THE INVENTION

It is accordingly the object of this invention to provide a sealed beam lamp including a halogen bulb having filaments along a direction of the diameter thereof, which can shield a direct external emission of a scattering light and alleviate a local excess heating of the bulb envelope to permit a halogen cycle to be better effected to assure a longer service life of the bulb.

According to this invention there is provided a sealed beam lamp comprising a lamp envelope comprised of a reflector having an open front and a lens attached to the edge of the open front of the reflector and a halogen bulb attached to the reflector such that its upper end surface is located opposite to the lens, said halogen bulb having a coiled type of straight filament along a direction of the diameter thereof and a light-shielding layer covered on the upper end portion of the bulb envelope except for those side wall portions of the bulb envelope facing the ends of the filaments, thereby preventing a direct external emission of light from the filament.

BRIEF DESCRIPTION OF THE DRAWINGS

This invention will be explained below by way of example by referring to the accompanying drawings in which.

PREFERRED EMBODIMENTS OF THE INVENTION

Figure 1:
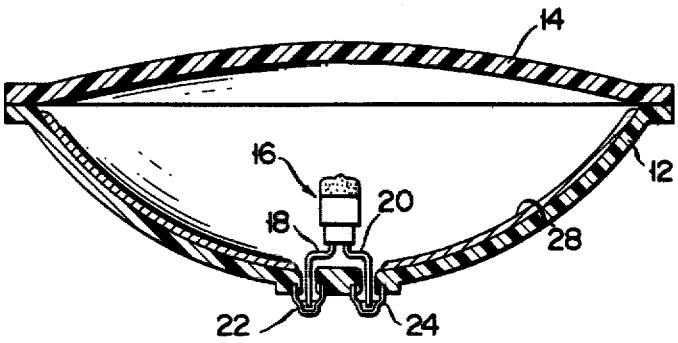
FIG. 1 is a cross-sectional view showing one form of a sealed beam lamp.
Figure 2:
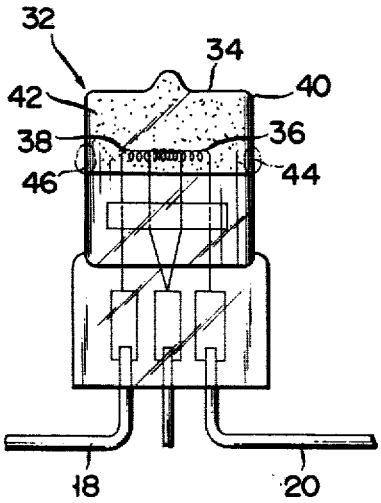
FIG. 2 PRIOR ART
FIG. 2 is a side view showing a conventional halogen bulb incorporated into a sealed beam lamp.
Figure 3:
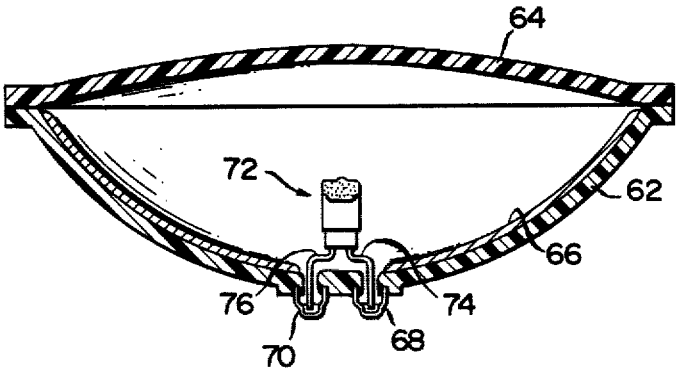
FIG. 3 is a cross-sectional view showing a sealed beam lamp according to this invention.

FIG. 3 is a cross-sectional view showing a sealed beam lamp according to this invention. A reflector 62 is equipped at its open front side with a lens 64 which is hermetically sealed thereto. The reflector 62 constitutes, together with the lens 64, an envelope of the sealed beam lamp. A light-reflective layer 66 is formed on the inner surface of the reflector 62. Ferrules 68, 70 are mounted at the central portion of the back side of the reflector 62. Within the sealed beam lamp a halogen bulb 72 is fixed to the reflector 62. Stated in more detail, the halogen bulb 72 is mounted within the lamp envelope by securing filament lead lines 74, 76 of the halogen bulb to the central portion of the reflector 62 by means of the ferrules 68, 70. In this embodiment, one more lead line 78 (see FIG. 4), though not shown in FIG. 3, is provided.

Figure 4:
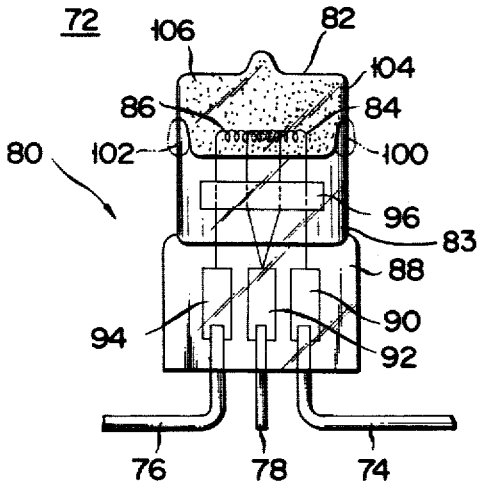
FIG. 4 is a side view showing a halogen bulb incorporated into a sealed beam lamp as shown in FIG. 3.
Figure 5:
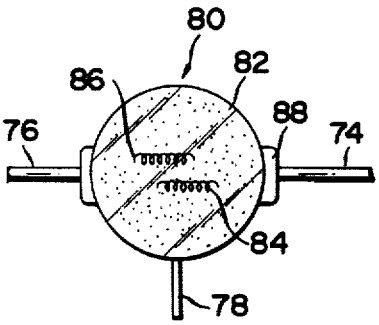
FIGS. 5 and 6 show a plan view and side view, respectively, of the FIG. 4 halogen bulb.
Figure 6:
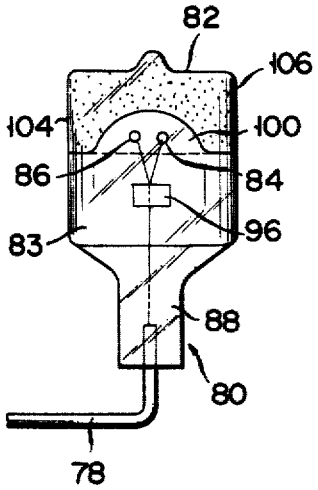
Figure 7:
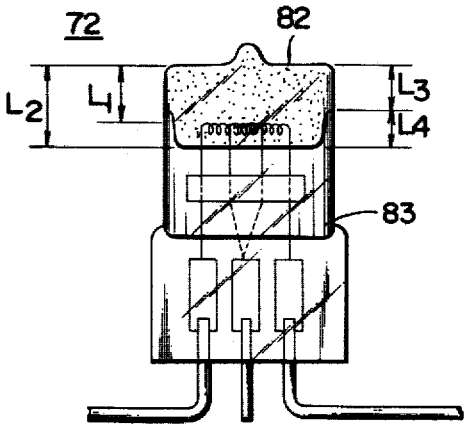
FIG. 7 is a side view showing a halogen bulb incorporated into a sealed beam lamp, a dimension between the upper end of the bulb, a filament and the portions of a light-shielding layer on the upper end portion of the bulb being shown for explanation.

FIG. 4 shows a halogen bulb 72 incorporated into a sealed beam lamp as shown in FIG. 3 and FIGS. 5 and 6 show a plan view and side view, respectively, of the halogen bulb 72 of FIG. 4. As evident from FIGS. 4 to 6, an envelope 80 of the halogen bulb 72 is substantially cylindrical in configuration and has a substantially flat top surface or portion 82 and a lower portion 83 near reflector 62. The envelope 80 of the halogen bulb is made of a heat-resistant glass, because it suffers a greater amount of heat energy during the operation of the halogen bulb 72. Within the envelope, two straight filaments 84, 86 of the coiled type are horizontally located in the neighborhood of the inner surface of the top of the envelope. As apparent from FIG. 5 the filaments 84, 86 are arranged parallel to each other such that they are somewhat mutually displaced in a direction of the diameter of the envelope. The filaments 84, 86 can be used, for example, for near-distant and far-distant illumination. A base 88 of the bulb 80 is formed by collapsing the lower portion of a bulb envelope flat during the softened state of the envelope with three molybdenum (Mo) foils 90, 92, 94 sealed therein. One connection line of the filament 84 for near-distant illumination is connected to the upper end of the foil 90 through a support member 96 which is provided within the envelope 80 of the halogen bulb. The other connection line of the filament 84 is connected through the support member 96 to the upper end of the molybdenum foil 92. Likewise, one connection line of the filament 86 for far-distant illumination is connected through the support member 96 to the upper end of the foil 94. The other connection line of the filament 86 is connected through the support member 96 to the upper end of the molybdenum foil 92. To the end portions of the respective molybdenum foils 90, 92 and 94 are connected the lead lines 74, 78 and 76 which extend externally from the base 88 of the halogen bulb. A light shielding layer 106 made of, for example, graphite is formed extending from the upper end surface portion 82 of the bulb envelope down toward the lower portion 83 to a level below the filaments 84, 86 except for those side wall portions 100, 102 of the bulb facing the ends of the straight filaments 84, 86. Use is made of, for example, a halogen bulb having coiled type straight filaments rated at 12 V, 35 W and 12 V, 50 W respectively, in which a distance L1 between the upper end surface 82 of the bulb and the filaments 84, 86 is 5 mm, a distance L2 between the upper end surface 82 and the lowest edge of the light shielding layer 106 is 7 mm, a distance L3 between the upper end surface 82 of the bulb and the bottom of an uncovered recess defined by the light-shielding layer is 4 mm and a distance L4 between the bottom of the recess defined by the light-shielding layer and the lowest edge of the light-shielding layer 106 is 3 mm.

As shown in FIG. 3 the lamp bulb 12 is secured to the reflector 62 with its front side directed toward the lens. As a result, the filaments 84, 86 of the halogen bulb 72 are disposed in a substantially parallel relation to the lens 64. A power source circuit for turning on the filaments 84, 86 is connected through the feed lines 74, 78 and 76, 78 to the filaments 84 and 86. A changeover switch not shown is connected between the filaments 84, 86 and the power source circuit to selectively turn on the filaments 84, 86.

The operation of the sealed beam lamp will be explained below.

Suppose that the filament is turned on by electric power from the power source circuit. In this case, light is emitted in all directions from the entire periphery of the filaments. Those beams of light which strike the reflective layer 66 are converted into parallel beams of light and then focussed, as an effective light, onto a predetermined, distant spot through the lens 64. Those beams of light which strike the inner surface of the upper end portion of the bulb envelope are reflected on the light-shielding layer 106 and prevented from being directly externally emitted toward the lens and thus impart no dazzling effect to the driver on the oncoming vehicle. The beams of light shielded by the light-shielding layer fall onto the reflective layer 66 and, after reflection on the reflective layer 66, are converted into parallel beams of light and externally emitted as a focussed pattern of light. In this way, the beams of light reflected on the reflective layer all act as an effective light without the direct external emission of the scattering light.

The light-shielding layer 106 on the upper end portion of the bulb envelope somewhat absorbs a beam of incident light and is heated to some extent. Since, however, the filaments are located some distances away from the light-shielding layer, the heating of the bulb envelope is not to such an extent that the halogen cycle becomes inactivated due to the giving off of a harmful gas. The side wall portions 100, 102 of the bulb envelope which face the ends of the straight filaments are located in close proximity to the ends of the filaments and receive a greatest amount of heat. According to this invention, however, the side wall portions 100, 102 of the bulb envelope are not covered with the light-shielding layer 106 and permits the incident light to be passed without absorbing any appreciable amount of such a light. For this reason, the side wall portions 100, 102 of the bulb envelope are prevented from being locally excessively heated to a high temperature and a harmful gas is hardly given off. In consequence, the halogen cycle remains activated and no earlier local blackening occurs on the inner surface of the bulb envelope with the attendant lengthening of the service life of the bulb.

Although in the above-mentioned embodiment the operation of the filament for near-distant illumination has been explained, the above explanation is equally applied to the filament 86 for far-distant illumination. According to this invention a sealed beam lamp having a single-filament type halogen bulb can be used instead of the sealed beam lamp incorporating a two-filament type halogen bulb. Use may also be made of any straight type of filaments, such as a straight filament of a plate type. The sealed beam lamp of this invention is suitable for use not only as a headlight of automobiles, but also as a headlight of ships, trains, bicycles etc. or as lighting fixtures in a tunnel.

According to this invention a sealed beam lamp comprises an envelope comprised of a reflector having an open front and a lens attached to the edge of the open front of the reflector, and a halogen bulb attached to the reflector and having a substantially straight filament arranged along a direction of the diameter thereof and substantially parallel to the lens and a bulb envelope whose upper end portion is covered with a light-shielding layer except for those side walls of the bulb envelope facing the ends of the straight filaments. The arrangement of the halogen bulb prevents a direct external emission of light from the filaments i.e., causing those beams of light sealed on the light shielding layer on the bulb envelope to strike the reflector surface to permit them to be converted into parallel beam of light for external emission as an effective beam of light. Since those side wall portions of the bulb envelope facing the ends of the filaments are prevented from being locally excessively heated due to the absence of the light-shielding layer, the halogen cycle remains activated over the whole area of the interior of the halogen bulb, preventing an earlier local blackening of the bulb and thus assuring a longer service life of the bulb.

What we claim is:

1. A sealed beam lamp comprising:

a lamp envelope comprised of a reflector having an open front and a lens attached to the edge of the open front of the reflector; and a halogen bulb attached to the reflector so as to face the lens and including at least one substantially straight filament arranged along a direction of the diameter thereof and substantially parallel to the lens and a bulb envelope having a lower portion disposed near the reflector and an upper portion, the bulb envelope having a light shielding layer extending from the upper portion down toward the lower portion to a level below the at least one filament except for that side wall portion of the bulb envelope facing at least one end of the at least one straight filament, thereby preventing a direct external emission of light from the filament.

2. A sealed beam lamp according to claim 1 in which said filament is only in number.

3. A sealed beam lamp according to claim 1 in which said filament is only in number.

4. A sealed beam lamp according to claim 3 in which said filaments have a different rating.

5. A sealed beam lamp according to claim 3 in which said two filaments have 12 V, 35 W and 12 V, 50 W, respectively and a distance between the upper end surface of the halogen bulb and the filament is 5 mm, a distance between the upper end surface of the bulb and the lowest edge of the light-shielding layer is 7 mm, a distance between the upper end surface of the bulb and the bottom of an uncovered recess defined by the light-shielding layer is 4 mm and a distance between the lowest edge of the light-shielding layer and the bottom of the recess is 3 mm.

6. A sealed beam lamp according to claim 1 in which the light-shielding layer is made of graphite.

7. A sealed beam lamp according to claim 1 in which the straight filament is of a coiled type.

* * * * *